US009867248B2

(12) United States Patent
Yeh et al.

(10) Patent No.: US 9,867,248 B2
(45) Date of Patent: Jan. 9, 2018

(54) DIMMING MODULE, SOLID STATE LIGHTING DEVICE, AND DIMMING METHOD

(71) Applicant: Lextar Electronics Corporation, Hsinchu (TW)

(72) Inventors: Chien-Nan Yeh, Kaohsiung (TW); Chun-Jong Chang, Hsinchu County (TW); Po-Shen Chen, Hsinchu (TW); Kai-Hsiang Shih, Changhua County (TW); Jhao-Cyuan Huang, New Taipei (TW); Ku-Cheng Lin, Taoyuan (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 0 days.

(21) Appl. No.: 15/361,076

(22) Filed: Nov. 25, 2016

(65) Prior Publication Data

US 2017/0215244 A1 Jul. 27, 2017

(30) Foreign Application Priority Data

Jan. 21, 2016 (TW) ..... 105101896 A

(51) Int. Cl.
*H05B 37/02* (2006.01)
*H05B 33/08* (2006.01)

(52) U.S. Cl.
CPC ..... *H05B 33/0845* (2013.01); *H05B 33/083* (2013.01); *H05B 33/0857* (2013.01)

(58) Field of Classification Search
CPC ..... H05B 33/0815; H05B 33/0845; H05B 33/0818
USPC ..... 315/193, 291
See application file for complete search history.

(56) References Cited

U.S. PATENT DOCUMENTS 8,018,171 B1 * 9/2011 Melanson ..... H05B 33/0815 315/194
8,638,045 B2 * 1/2014 Kunst ..... H05B 33/0815 315/185 S
2008/0224629 A1 * 9/2008 Melanson ..... H05B 33/0815 315/247

(Continued)

FOREIGN PATENT DOCUMENTS

CN 104853479 A 8/2015
TW M381241 U1 5/2010

(Continued)

*Primary Examiner* — Don Le
(74) *Attorney, Agent, or Firm* — CKC & Partners Co., Ltd.

(57) ABSTRACT

A dimming module and a solid state lighting device are shown. The dimming module includes a rectifying circuit, a phase control circuit, a processing circuit and a first driving circuit. The rectifying circuit is configured to convert an input AC voltage to a rectified voltage signal. The phase control circuit is configured to receive the rectified voltage signal and a dimming command, and output a control voltage signal correspondingly in which the phase control circuit controls a phase delay angle of the control voltage signal according to the dimming command. The processing circuit is configured to receive the control voltage signal and adjust a first driving voltage signal according to the phase delay angle. The first driving circuit is configured to receive the first driving voltage signal to drive a first lighting module.

20 Claims, 5 Drawing Sheets

(56) References Cited

U.S. PATENT DOCUMENTS

| | | | | |
|---|---|---|---|---|
| 2009/0243582 | A1* | 10/2009 | Irissou | H05B 39/08 323/320 |
| 2011/0285301 | A1* | 11/2011 | Kuang | H05B 33/0845 315/200 R |
| 2015/0312982 | A1* | 10/2015 | Melanson | H05B 33/0815 315/287 |
| 2016/0234893 | A1* | 8/2016 | Nishizono | H05B 33/0815 |

FOREIGN PATENT DOCUMENTS

| | | | |
|---|---|---|---|
| TW | 201215234 | A1 | 4/2012 |
| TW | 201233233 | A1 | 8/2012 |
| TW | M500858 | U | 5/2015 |

* cited by examiner

DIMMING MODULE, SOLID STATE LIGHTING DEVICE, AND DIMMING METHOD

RELATED APPLICATIONS

This application claims priority to Taiwan Application Serial Number 105101896, filed Jan. 21, 2016, which is herein incorporated by reference.

BACKGROUND

Technical Field

The present disclosure relates to a dimming module and a solid state lighting device, particularly, to the dimming module and the solid state lighting device with adjustable color temperature.

Description of Related Art

In recent times, due to the advantages of light emitting diode such as high efficiency, and the ability of energy saving, light emitting diodes (LEDs) have replaced traditional lighting sources in many applications and have become an important area of research.

However, when dimming the brightness and the color temperature of the existing solid state lighting device using LEDs, two or more set of the phase-cut dimmers are required to control the brightness and the color temperature separately. In addition, the problems such as instability and undesired flickering may occur when traditional phase-cut dimmers are used to provide the dimming control of the LEDs. Accordingly, ways in which to simplify the adjustment of the brightness and the color temperature for the solid state light source device and to improve the stability of the dimming control are important research issues and urgent objects in the relevant field.

SUMMARY

An aspect of the present disclosure is a dimming module. The dimming module includes a rectifying circuit, a phase control circuit, a processing circuit, and a first driving circuit. The rectifying circuit is configured to convert an input ac voltage to a rectified voltage signal. The phase control circuit is configured to receive the rectified voltage signal and a dimming command, and output a control voltage signal correspondingly, in which the phase control circuit controls a phase delay angle of the control voltage signal according to the dimming command. The processing circuit is configured to receive the control voltage signal and adjust a first driving voltage signal according to the phase delay angle. The first driving circuit is configured to receive the first driving voltage signal to drive a first lighting module. The phase control circuit outputs the non-full-phase control voltage signal with the phase delay angle to the processing circuit in one or more cycles and then the phase control circuit outputs the full-wave rectified voltage with full waveform.

Another aspect of the present disclosure is a solid state lighting device. The solid state lighting device includes a first lighting module with a first color temperature, a second lighting module with a second color temperature different from the first color temperature, a first driving circuit, a second driving circuit, a phase control circuit, and a processing circuit. The first driving circuit is configured to receive a first driving voltage to drive the first lighting module. The second driving circuit is configured to receive a second driving voltage to drive the second lighting module. The phase control circuit is configured to output a control voltage signal. When the phase control circuit receives a dimming command, the phase control circuit controls a phase delay angle of the control voltage signal according to the dimming command. The processing circuit is electrically coupled to the phase control circuit, the first driving circuit, and the second driving circuit, and is configured to receive the control voltage signal and adjust the first driving voltage signal and the second driving voltage signal according to the phase delay angle. The phase control circuit outputs the non-full-phase control voltage signal with the phase delay angle to the processing circuit in one or more cycles and then the phase control circuit outputs the full-wave rectified voltage with full waveform.

Yet another aspect of the present disclosure is a dimming method. The dimming method includes receiving, by a phase control circuit, a dimming command from an external device; determining, by the phase control circuit, the dimming command is a color temperature control command or a brightness control command; outputting a control voltage signal with a first phase delay angle when the dimming command is the brightness control command; outputting the control voltage signal with a second phase delay angle when the dimming command is the color temperature control command; adjusting a first driving voltage signal and a second driving voltage signal according to the control voltage signal; driving a first lighting module and a second lighting module respectively according to the first driving voltage signal and the second driving voltage signal; and outputting a full-wave rectified voltage with full waveform after the non-full-phase control voltage signal with the first phase delay angle or the second phase delay angle in one or more cycles is outputted.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
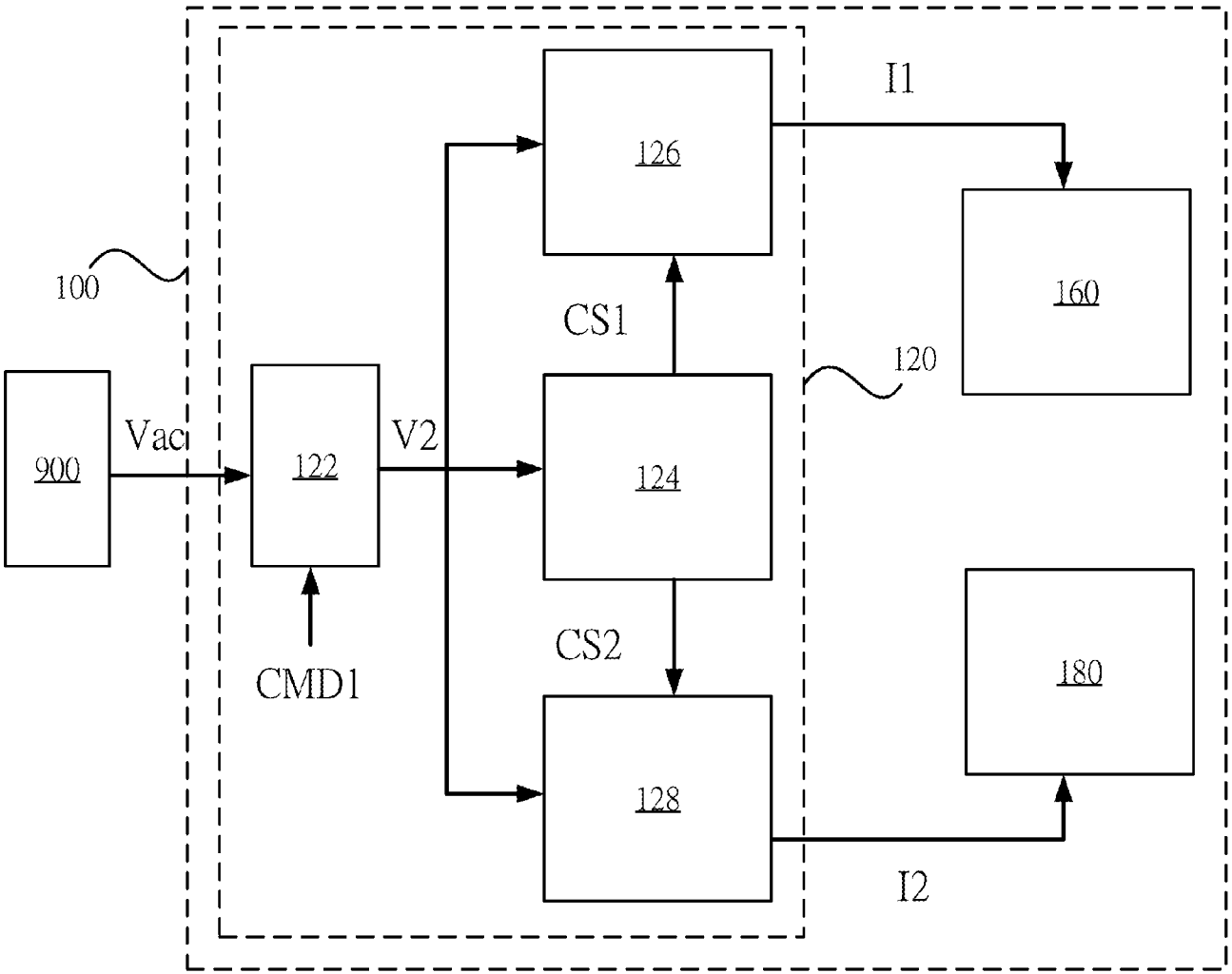
FIG. 1 is a schematic diagram illustrating a solid state lighting device according to some embodiments of the present disclosure.

Reference will now be made in detail to embodiments of the present disclosure, examples of which are described herein and illustrated in the accompanying drawings. While the disclosure will be described in conjunction with embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. It is noted that, in accordance with the standard practice in the industry, the drawings are only used for understanding and are not drawn to scale. Hence, the drawings are not meant to limit the actual embodiments of the present disclosure. In fact, the dimensions of the various features may be arbitrarily increased or reduced for clarity of discussion. Wherever possible, the same reference numbers are used in the drawings and the description to refer to the same or like parts for better understanding.

The terms used in this specification and claims, unless otherwise stated, generally have their ordinary meanings in the art, within the context of the disclosure, and in the specific context where each term is used. Certain terms that are used to describe the disclosure are discussed below, or elsewhere in the specification, to provide additional guidance to the practitioner skilled in the art regarding the description of the disclosure.

In addition, in the following description and in the claims, the terms "include" and "comprise" are used in an open-ended fashion, and thus should be interpreted to mean "include, but not limited to." As used herein, the term "and/or" includes any and all combinations of one or more of the associated listed items.

In this document, the term "coupled" may also be termed "electrically coupled," and the term "connected" may be termed "electrically connected." "Coupled" and "connected" may also be used to indicate that two or more elements cooperate or interact with each other. It will be understood that, although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments.

Reference is made to FIG. 1. FIG. 1 is a schematic diagram illustrating a solid state lighting device 100 according to some embodiments of the present disclosure. As shown in FIG. 1, the solid state lighting device 100 includes a lighting module 160, a lighting module 180, and a dimming module 120 configured to adjust the luminosity of the lighting module 160 and the lighting module 180. In some embodiments, the dimming module 120 includes a phase control circuit 122, a processing circuit 124, a driving circuit 126 and a driving circuit 128.

In some embodiments, an AC power source 900 provides an input AC voltage Vac as the electricity supply of the solid state lighting device 100. The phase control circuit 122 receives a dimming command CMD1 and correspondingly output a control voltage signal V2 to the processing circuit 124, the driving circuit 126 and the driving circuit 128. The processing circuit 124 outputs driving voltage control signals CS1 and CS2 to the driving circuit 126 and the driving circuit 128 respectively according to the control voltage signal V2. The driving circuit 126 and the driving circuit 128 control the current I1 and I2 of the lighting module 160 and the lighting module 180 respectively after receiving the driving voltage signals CS1 and CS2, in order to adjust the luminosity of each of the lighting module 160 and the lighting module 180.

Therefore, if the lighting module 160 and the lighting module 180 have different color temperatures, the brightness and the color temperature of the solid state lighting device 100 may be correspondingly controlled by adjusting the amplitude of the current I1 and I2 and the ratio between the current I1 and I2. In the following paragraphs, the specific circuit details will be explained with accompanying figures.

Figure 2:
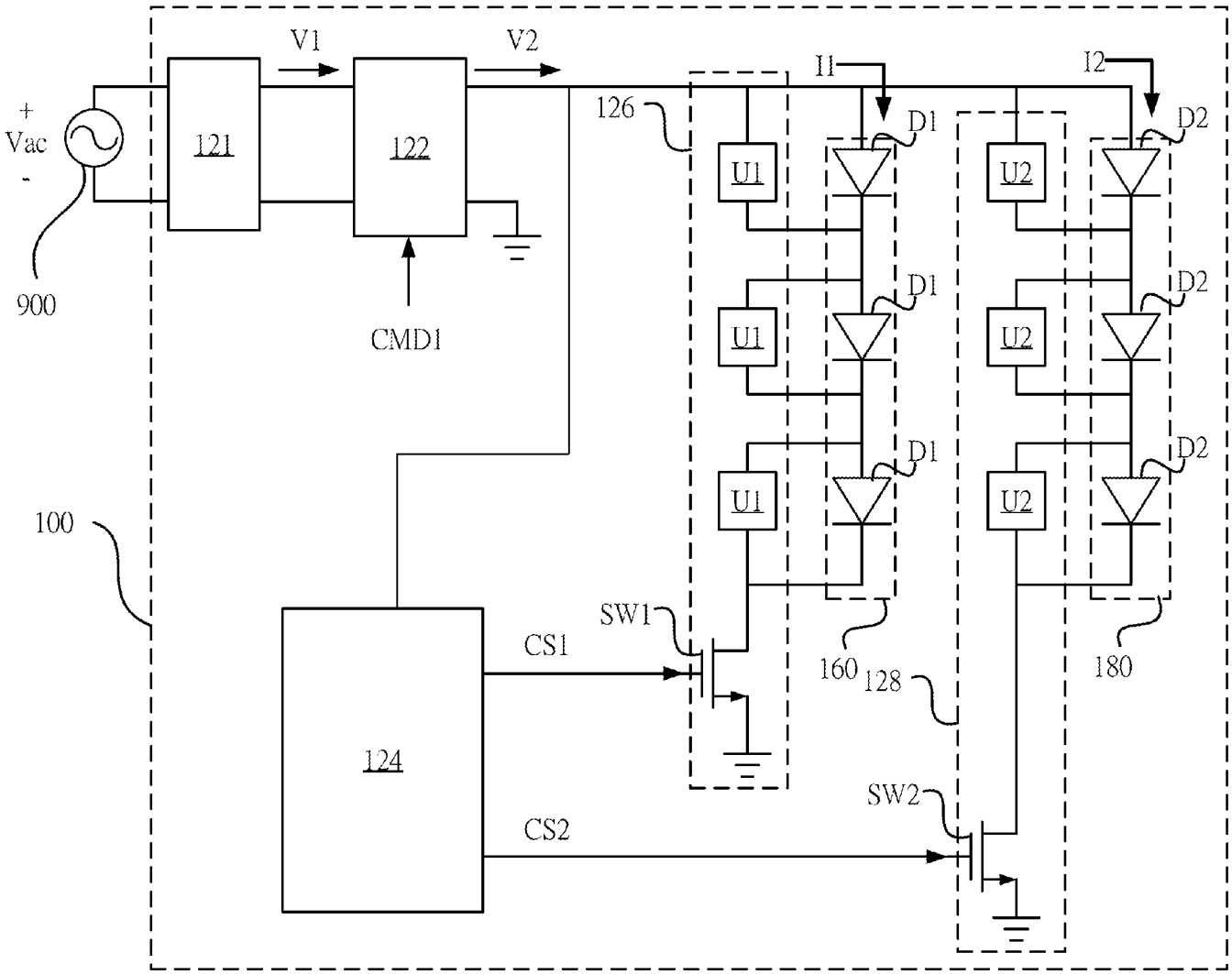
FIG. 2 is a schematic diagram illustrating a solid state lighting device according to some embodiments of the present disclosure.

Reference is made to FIG. 2. FIG. 2 is a schematic diagram illustrating the solid state lighting device 100 according to some embodiments of the present disclosure. As shown in FIG. 2, in some embodiments, the solid state lighting device 100 includes the lighting module 160, the lighting module 180, and the dimming module 120 configured to adjust the luminosity of the lighting module 160 and the lighting module 180. In some embodiments, the dimming module 120 includes a rectifying circuit 121, the phase control circuit 122, the processing circuit 124, the driving circuit 126 and the driving circuit 128.

The rectifying circuit 121 is electrically coupled to the AC power source 900. The rectifying circuit 121 receives the input AC voltage Vac from the AC power source 900 and performs rectification to convert the input AC voltage Vac to a rectified voltage signal V1. For example, the rectifying circuit 121 may be implemented by a bridge rectifier including multiple diodes. It is noted that the rectifying circuit 121 may be realized in various ways and the rectifying circuit 121 in the present disclosure is not limited to the bridge rectifier.

Figure 3:
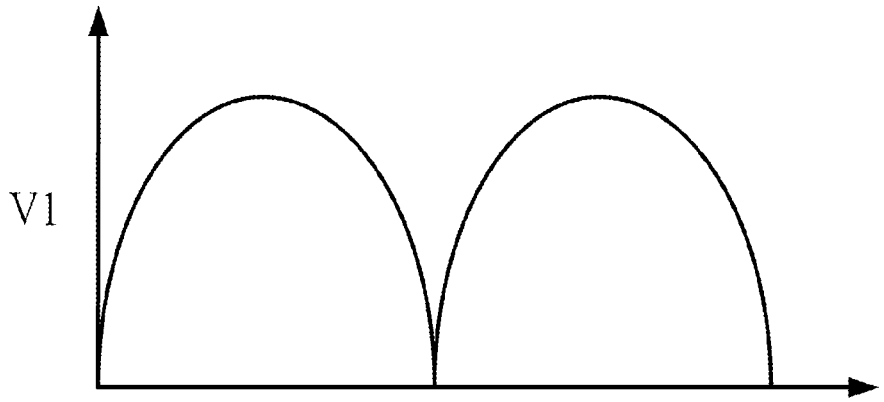
FIG. 3 is a wave diagram illustrating the rectified voltage signal according to some embodiments of the present disclosure.

Reference is made to FIG. 3. FIG. 3 is a wave diagram illustrating the rectified voltage signal V1 according to some embodiments of the present disclosure. As shown in FIG. 3, after the full-wave rectification is performed to the input AC voltage Vac by the rectifying circuit 121, the outputted rectified voltage signal V1 is the upper half of the sinusoidal wave in each cycle.

Reference is made to FIG. 2. The phase control circuit 122 is electrically coupled to the rectifying circuit 121 and configured to receive the rectified voltage signal V1 from the rectifying circuit 121. In addition, the phase control circuit 122 also receives the dimming command CMD1 from the external. Specifically, in some embodiments, the dimming command CMD1 may be a remote signal outputted from a remote controller. In some other embodiments, the dimming command CMD1 may be a wall-control signal outputted from a wall controller located on the wall. No matter whether the dimming command CMD1 is a remote signal or a wall-control signal, it may be received by a corresponding signal receiving unit and transmitted to the phase control circuit 122 for the following dimming operations performed by the solid state lighting device 100. In addition, in some embodiments, the dimming command CMD1 may include the dimming instruction of adjusting the brightness of the light outputted from the solid state lighting device 100, and the dimming instruction of adjusting the color temperature of the light outputted from the solid state lighting device 100, but the present disclosure is not limited thereto. For example, in some embodiments, the dimming command CMD1 may also include various types of dimming instructions such as timer switch configurations or lighting mode selections.

After receiving the dimming command CMD1 from the external, the phase control circuit 122 may correspondingly output the control voltage signal V2 according to the rectified voltage signal V1 and the dimming command CMD1. In some embodiments, the phase control circuit 122 controls the phase delay angle of the control voltage signal V2 according to the dimming command CMD1.

Figure 4A:
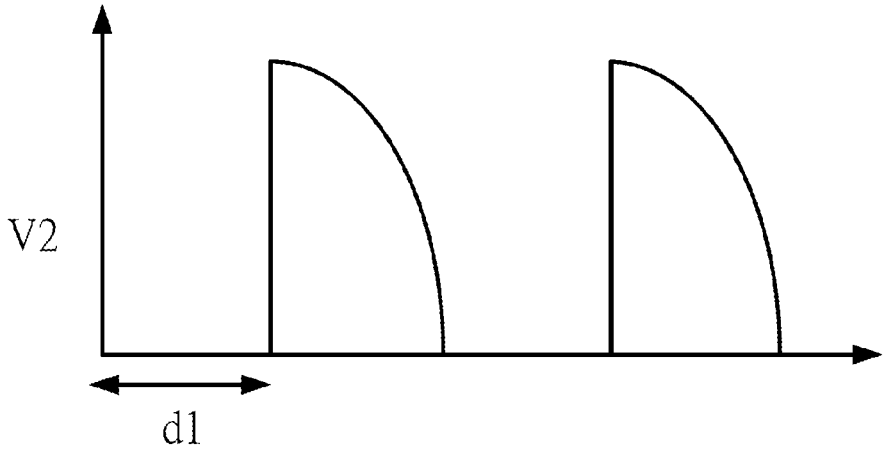
FIG. 4A and FIG. 4B are wave diagrams illustrating the control voltage signal according to some embodiments of the present disclosure.
Figure 4B:
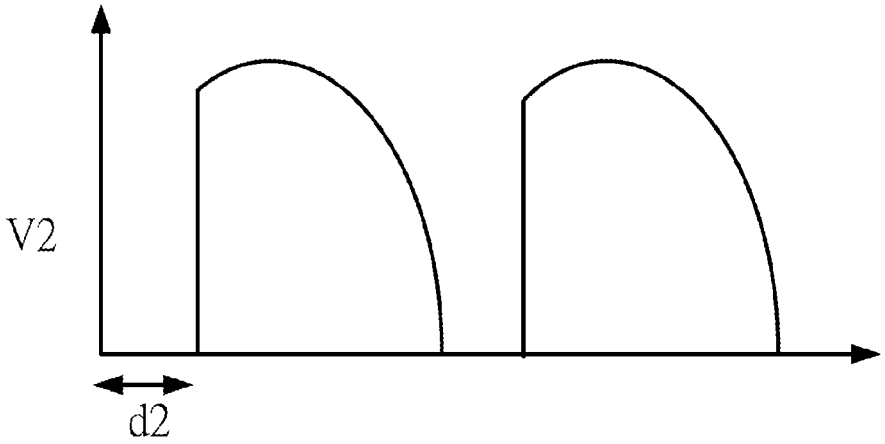

Reference is made to FIG. 4A and FIG. 4B. FIG. 4A and FIG. 4B are wave diagrams illustrating the control voltage signal V2 according to some embodiments of the present disclosure. For ease of explanation, the rectified voltage signal V1 shown in the FIG. 2 is incorporated by reference for better understanding of the waveform of the control voltage signal V2 illustrated in FIG. 4A and FIG. 4B. As shown in FIG. 4A and FIG. 4B, the waveform of the control voltage signal V2 is obtained by performing a trigger delay to the rectified voltage signal V1 with the full-wave rectification. Alternatively stated, in FIG. 4A, the control voltage signal V2 has a phase delay angle d1. In the phase delay angle d1 (e.g., about 3-4 ms), the control voltage signal V2 is zero, and after the phase delay angle d1, the control voltage signal V2 has the same voltage waveform as the rectified voltage signal V1.

Similarly, in FIG. 4B, the control voltage signal V2 has a phase delay angle d2. In the phase delay angle d2 (e.g., about 1-2 ms), the control voltage signal V2 is zero, and after the phase delay angle d2, the control voltage signal V2 has the same voltage waveform as the rectified voltage signal V1. The value of the phase delay angles d1 and d2 may be controlled and adjusted by the phase control circuit 122 according to different dimming commands CMD1. For example, in some embodiments, the control voltage signal V2 having the phase delay angle d1 in the FIG. 4A corresponds to the dimming instruction of adjusting the brightness of the light outputted from the solid state lighting device 100. On the other hand, the control voltage signal V2 having the phase delay angle d2 in the FIG. 4B corresponds to the dimming instruction of adjusting the color temperature of the light outputted from the solid state lighting device 100. Alternatively stated, when the dimming command CMD1 is a color temperature control command, the control voltage signal V2 is a trigger-delayed non-full-phase signal with phase delay angle d1. On the other hand, when the dimming command CMD1 is a brightness control command, the control voltage signal V2 is a trigger-delayed non-full-phase signal with phase delay angle d2, which is different from the phase delay angle d1.

Specifically, in some embodiments, the phase control circuit 122 may be a phase-cut dimmer, which may be implemented by switching elements such as a triode for alternating current (TRIAC). In some embodiments, the phase-cut dimmer cuts off a portion of the rectified voltage signal V1 by the trigger delay and correspondingly outputs the control voltage signal V2, but the present disclosure is not limited thereto. One skilled in the art may also choose other electronic elements to realize the phase control circuit 122 in various embodiments of the present disclosure.

Reference is made to FIG. 2 again. As shown in FIG. 2, the processing circuit 124 is electrically coupled to an output terminal of the phase control circuit 122 and configured to receive the control voltage signal V2. Thus, the processing circuit 124 may detect the waveform of the control voltage signal V2, and adjust and output the driving voltage signal CS1 and the driving voltage signal CS2 according to the phase delay angle of the control voltage signal V2. Alternatively stated, the processing circuit 124 may determine the dimming command is a brightness control command or a color temperature control command based on whether the trigger-delayed control voltage signal V2 has the phase delay angle d1 or the phase delay angle d2, and correspondingly outputs driving voltage signal CS1 and driving voltage signal CS2 accordingly to achieve dimming.

In some embodiments, the driving voltage signals CS1 and CS2 outputted by the processing circuit 124 may be the pulse width modulation (PWM) signal or analog dimming (ADIM) signal. In some embodiments, the analog dimming signal may be the ADIM signal with the amplitude of about 1V to 10V.

It is noted that, in the implementation, the processing circuit 124 may be achieved by various ways such as using a microcontroller (MCU), a digital signal processor (DSP), or a field programmable gate array (FPGA), etc.

In the embodiments that the driving voltage signals CS1 and CS2 are pulse width modulation signals, the processing circuit 124 may adjust the duty cycle of the driving voltage signals CS1 and CS2, in which the duty cycle is the ratio of the time of the driving voltage signals CS1 and CS2 having the high voltage level in the entire period. On the other hand, in the embodiments that the driving voltage signals CS1 and CS2 are ADIM signals, the processing circuit 124 may adjust the voltage levels of the driving voltage signals CS1 and CS2.

The driving circuit 126 and 128 receive the driving voltage signals CS1 and CS2 respectively, and drive the lighting module 160 and the lighting module 180 respectively according to the driving voltage signals CS1 and CS2. Specifically, as shown in FIG. 2, in some embodiments, the driving circuit 126 includes a switch SW1 and multiple driving units U1 electrically coupled in series to each other, in which the driving units U1 correspond to multiple light emitting diodes D1 electrically coupled in series to each other in the lighting module 160.

As shown in the figure, in some embodiments, the driving circuits 126 and 128 are further electrically coupled to the phase control circuit 122. The phase control circuit 122 is configured to output the control voltage signal V2 to the driving circuit 126 and the driving circuit 128, to supply power to the lighting module 160 and the lighting module 180, but the present disclosure is not limited thereto. The electricity source of the driving circuit 126 and the driving circuit 128 for driving the lighting module 160 and the lighting module 180 may be independent from the control voltage signal V2.

A first terminal of the switch SW1 is electrically coupled to the driving unit U1, and a second terminal of the switch SW1 is electrically coupled to a ground terminal, and a control terminal of the switch SW1 is electrically coupled to the processing circuit 124 and configured to receive the driving voltage signal CS1 to drive the lighting module 160. When the driving voltage signal CS1 is at a first level (e.g., high level), the switch SW1 is ON such that the current I1 flows through the light emitting diodes D1 in the lighting module 160. On the other hand, when the driving voltage signal CS1 is at a second level (e.g., low level), the switch SW1 is OFF such that the current flowing through the light emitting diodes D1 in the lighting module 160 is zero. Alternatively stated, the switch SW1 is selectively turned ON or OFF according to the driving voltage signal CS1 to control the current I1 flowing through the lighting module 160.

Therefore, by properly controlling the duty cycle of the driving voltage signal CS1, the amplitude of the current I1 may be controlled and thus the luminosity of the lighting module 160 is further controlled.

Figure 5A:
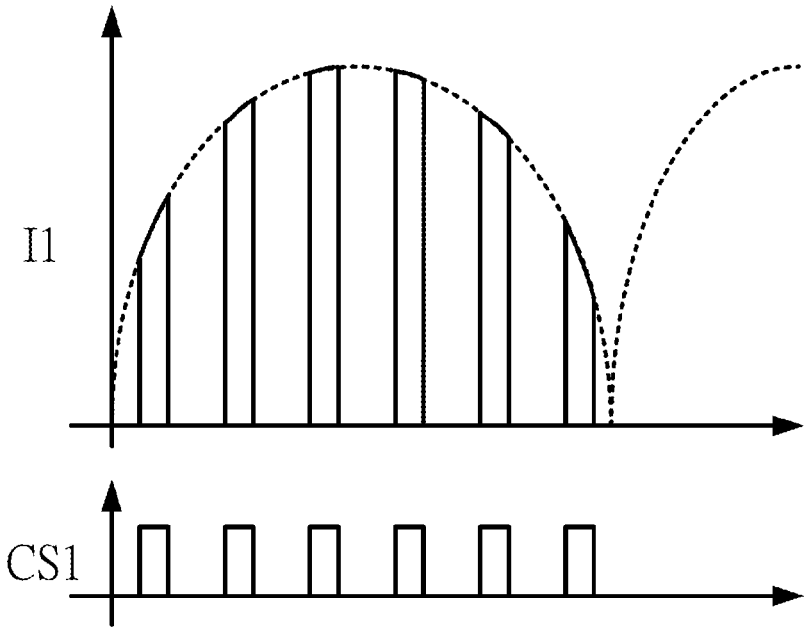
FIG. 5A and FIG. 5B are wave diagrams illustrating the driving voltage signal and the driving current according to some embodiments of the present disclosure.
Figure 5B:
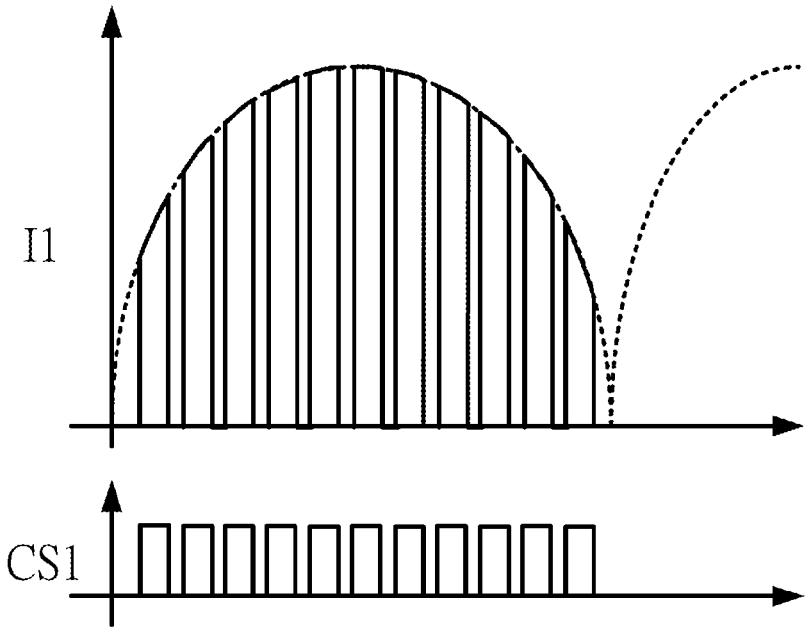

Reference is made to FIG. 5A and FIG. 5B. FIG. 5A and FIG. 5B are wave diagrams illustrating the driving voltage signal CS1 and the driving current I1 according to some embodiments of the present disclosure.

As shown in FIG. 5A, when the duty cycle of the driving voltage signal CS1 is small, the time period of the driving voltage signal CS1 being at the high level is short, and thus the time the lighting module 160 turned ON is short, and therefore a small current I1 on average flowing through the lighting module 160 in a period. On the other hand, as shown in FIG. 5B, when the duty cycle of the driving voltage signal CS1 is large, the time period of the driving voltage signal CS1 being at the high level is long, and thus the time the lighting module 160 turned ON is long, and therefore a large current I1 on average flowing through the lighting module 160 in the period. Therefore, the processing circuit 124 may adjust the current I1 flowing through the lighting module 160 by adjusting the duty cycle of the driving voltage signal CS1, to achieve the result of adjusting the luminosity of the lighting module 160.

Similar to the driving module 126, the driving module 128 includes a switch SW2 and multiple driving units U2 electrically coupled in series to each other, in which the driving units U2 correspond to multiple light emitting diodes D2 electrically coupled in series to each other in the lighting module 180.

A first terminal of the switch SW2 is electrically coupled to the driving unit U2, and a second terminal of the switch SW2 is electrically coupled to a ground terminal, and a control terminal of the switch SW2 is electrically coupled to the processing circuit 124 and configured to receive the driving voltage signal CS2 to drive the lighting module 180. Therefore, by properly controlling the duty cycle or the voltage level of the driving voltage signal CS2, the amplitude of the current I2 may be controlled and thus the luminosity of the lighting module 180 is further controlled. The detailed operation of the driving unit 128 is similar to the operation of the driving unit 126, and thus further explanations are omitted herein for the sake of brevity.

It is noted that, though in above paragraphs, the driving voltage signals CS1 and CS2 are pulse width modulation signals, in the embodiments the driving voltage signals CS1 and CS2 being ADIM signals, the different levels of the driving voltage signal CS1 and CS2 may also implement the control of the current I1 and I2, and thus achieve the result of adjusting the luminosity of the lighting modules 160 and 180. Therefore, the driving circuits 126 and 128 illustrated in the drawing are merely possible examples of the present disclosure. In various embodiments, the driving circuits 126 and 128 may include various receiving circuits corresponding to the type of the driving voltage signals CS1 and CS2 (e.g., PWM signals, ADIM signals, etc.). Therefore, the driving circuits 126 and 128 may adjust the amplitude of the current I1 and I2 according to the driving voltage signals CS1 and CS2, so as to adjust the brightness and color temperature of the light output by the solid state lighting device 100.

Specifically, in some embodiments, the lighting module 160 and the lighting module 180 may have different color temperatures. For example, the color temperature of the lighting module 160 may be a warm color temperature, such as about 3000K, and the color temperature of the lighting module 180 may be a cold color temperature, such as about 6000K, but the present disclosure is not limited thereto. One skilled in the art may choose various LEDs to design the lighting module 160 and the lighting module 180 with different color temperatures respectively based on practical needs.

Therefore, the processing circuit 124 may determine the types and the instructions of the dimming command CMD1 according to the control voltage signal V2, and adjust the driving voltage signals CS1 and CS2 correspondingly to adjust the luminosity of each of the lighting module 160 and the lighting module 180. Thus, not only the brightness of the output of the solid state lighting device 100 may be adjusted, the color temperature may also be adjusted by adjusting the ratio between the luminosity of the lighting module 160 and the luminosity of the lighting module 180.

For example, the processing circuit 124 may increase the luminosity of the lighting module 160 (e.g., warm light source with lower color temperature) and reduce the luminosity of the lighting module 180 (e.g., cold light source with higher color temperature) to reduce the color temperature of the light outputted by the solid state device 100 and give a warmer light. On the other hand, the processing circuit 124 may also reduce the luminosity of the lighting module 160 (e.g., warm light source with lower color temperature) and increase the luminosity of the lighting module 180 (e.g., cold light source with higher color temperature) to increase the color temperature of the light output by the solid state device 100 and emit light with a lower color temperature.

It is noted that, since the processing circuit 124 may output corresponding driving voltage signals CS1 and CS2 after detecting the phase delay angle of the control voltage signal V2, in some embodiments, the phase control circuit 122 may only output non-full-phase signal (i.e., the control voltage signal V2 with phase delay angle d1 or d2) to the processing circuit 124 in one or few cycles. Then, the phase control circuit 122 may output the voltage which is full-wave rectified and with full waveform to the driving circuit 126 and 128 and the lighting module 160 and 180. Therefore, the terminal voltage received by the lighting module 160 and 180 may remain stable and consistent, and do not vary due to the phase delay angle d1 and d2 of the control voltage signal V2. Thus, the luminosity of the lighting module 160 and 180 may maintain stability, which avoids the flickering issue resulting from the voltage variation when the control voltage signal V2 is used for dimming.

In addition, in some embodiments, the solid state lighting device 100 may further include three or more sets of driving circuits and lighting modules, which are driven by corresponding driving voltage signal, to further adjust the brightness, the color temperature or different lighting modes of the output of the solid state lighting module 100. In some embodiments, the phase control circuit 122 may also configure three or more sets of phase delay angles in order to correspond to different dimming commands, such as timer switch configurations or lighting mode selection, etc. Therefore, the processing circuit 124 may determine the dimming command according to different phase delay angles and perform corresponding process and control. Accordingly, the above embodiments are merely examples, such that the actual numbers of the driving circuits, lighting modules, and the LEDs in the lighting modules in the solid state lighting device 100, and the amounts of the phase delay angles with different angle configuration, and the degrees of the phase delay angles (e.g., the time of the trigger delay period) may be designed based on the practical needs, and the present disclosure is not limited thereto.

Figure 6:
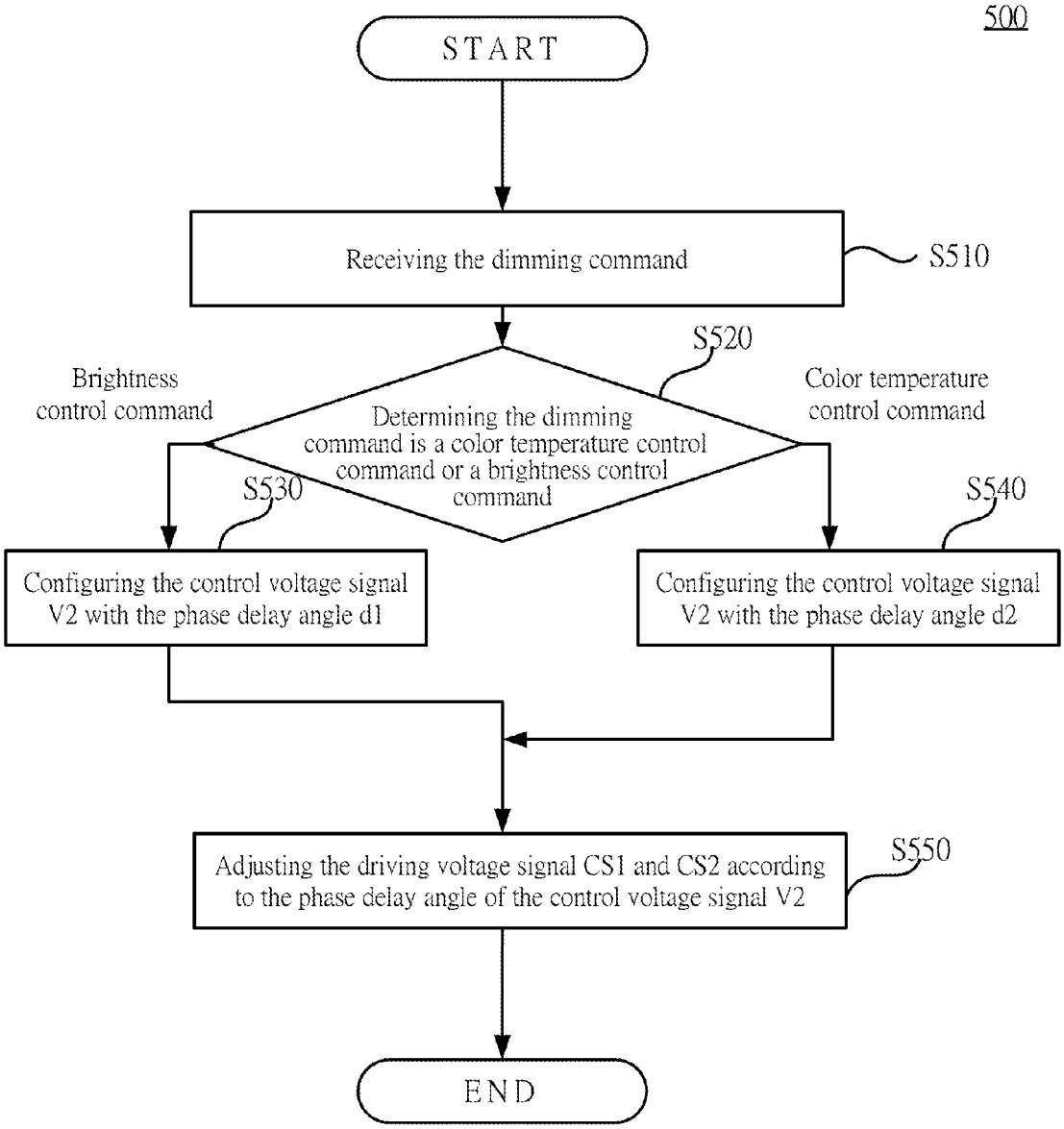
FIG. 6 is a flowchart illustrating a dimming method according to some embodiments of the present disclosure.

Reference is made to FIG. 6. FIG. 6 is a flowchart illustrating a dimming method 500 according to some embodiments of the present disclosure. For ease and clarity of the explanation, the dimming method 500 is discussed in relation to the embodiments in FIG. 1-FIG. 5A and FIG. 5B, but is not limited thereto. Those skilled in the art may make various modifications and variations without departing from the scope or spirit of the disclosure. As shown in FIG. 6, the dimming method 500 includes steps S510, S520, S530, S540 and S550.

First, in the step S510, the phase control circuit 122 receives the dimming command CMD1 from external devices such as a wall controller or a remote controller. For example, the dimming command CMD1 may be a wireless signal, for example, an IR signal, a radio signal, etc., sent by a remote controller.

Next, in the step S520, the phase control circuit 122 determines the dimming command is a color temperature control command or a brightness control command. When the dimming command CMD1 is a brightness control command, the procedure jumps to the step S530, and the phase control circuit 122 outputs the control voltage signal V2, and configures the control voltage signal V2 with the phase delay angle d1. When the dimming command CMD1 is a color temperature control command, the procedure jumps to the step S540, and the phase control circuit 122 outputs the control voltage signal V2, and configures the control voltage signal V2 with the phase delay angle d2.

In the end, in the step S550, the processing circuit 124 adjusts the driving voltage signals CS1 and CS2 according to the phase delay angle of the control voltage signal V2. Therefore, the driving circuits 126 and 128 may drive the lighting modules 160 and 180 according to the driving voltage signals CS1 and CS2 respectively. By adjusting the current I1 and I2 flowing through the lighting modules 160 and 180 respectively, the luminosity of each of the lighting module 160 and the lighting module 180 is controlled such that the brightness and the color temperature of the solid state lighting device 100 is adjusted. In some embodiments, the phase control circuit 122 outputs the full-wave rectified voltage with full waveform after the non-full-phase control voltage signal V2 with the phase delay angle d1 or the phase delay angle d2 is outputted for one or more cycles.

Those skilled in the art can directly understand how the operations and functions in the dimming method 500 are executed based on the solid state lighting device 100 in the various abovementioned embodiments, so further explanation is omitted herein for the sake of brevity.

The above description includes exemplary operations, but the operations are not necessarily performed in the order described. The order of the operations disclosed in the present disclosure may be changed, or the operations may even be executed simultaneously or partially simultaneously as appropriate, in accordance with the spirit and scope of various embodiments of the present disclosure.

It is noted that the switches SW1 and SW2, the rectifying circuit 121, and the LEDs in the lighting modules 160 and 180 may be implemented in various ways. For example, the switches SW1 and SW2 may be realized by Bipolar Junction Transistors (BJTs), Metal-Oxide-Semiconductor Field-Effect Transistors (MOSFETs) or other proper semiconductor elements.

In summary, in the present disclosure, by applying abovementioned embodiments, using the phase control circuit to adjust the non-full-phase waveform of the control voltage signal outputted to the processing circuit, the processing circuit is configured to output corresponding driving voltage signals to the driving circuits to drive the lighting modules according to the non-full-phase waveform. Therefore, one delay trigger is used to realize various different dimming commands such as tuning the brightness, tuning the color temperature, etc. in order to achieve dimming of the solid state lighting device. Thus, the manufacturing cost and the device size of the dimming module and the solid state lighting device is reduced, and the convenience of dimming control is improved.

Although the disclosure has been described in considerable detail with reference to certain embodiments thereof, it will be understood that the embodiments are not intended to limit the disclosure. It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A dimming module, comprising:

a rectifying circuit, configured to convert an input ac voltage to a rectified voltage signal;

a phase control circuit, configured to receive the rectified voltage signal and a dimming command, and output a control voltage signal correspondingly, wherein the phase control circuit controls a phase delay angle of the control voltage signal according to the dimming command;

a processing circuit, configured to receive the control voltage signal and adjust a first driving voltage signal according to the phase delay angle; and a first driving circuit, configured to receive the first driving voltage signal to drive a first lighting module;

wherein the phase control circuit outputs the non-full-phase control voltage signal with the phase delay angle to the processing circuit in one or more cycles and then the phase control circuit outputs the full-wave rectified voltage with full waveform; and wherein when the dimming command corresponds to a first type of dimming instructions, the phase delay angle comprises a first angle, and when the dimming command corresponds to a second type of dimming instructions different from the first type of dimming instructions, the phase delay angle comprises a second angle different from the first angle.

2. The dimming module of claim 1, wherein the first type of dimming instructions is a color temperature control command, and the second type of dimming instructions is a brightness control command.

3. The dimming module of claim 1, wherein the processing circuit is further configured to adjust a second driving voltage signal according to the phase delay angle, and the dimming module further comprises a second driving circuit configured to receive the second driving voltage signal to drive a second lighting module, wherein the first lighting module comprises a first color temperature, and the second lighting module comprises a second color temperature different from the first color temperature.

4. The dimming module of claim 3, wherein the first driving voltage signal and the second driving voltage signal are pulse-width modulation signals, and the processing circuit is configured to adjust duty cycles of the first driving voltage signal and the second driving voltage signal respectively according to the degree of the phase delay angle, to control current flowing through the first lighting module and the second lighting module.

5. The dimming module of claim 1, wherein the first driving circuit comprises a first switch, and a control terminal of the first switch is configured to receive the first driving voltage signal, such that the first switch is selectively turned on or turned off according to the first driving voltage signal so as to control current flowing through the first lighting module.

6. The dimming module of claim 5, wherein the dimming module further comprises a second driving circuit configured to receive a second driving voltage signal to drive a second lighting module, and the second driving circuit comprises a second switch, and a control terminal of the second switch is configured to receive the second driving voltage signal, such that the second switch is selectively turned on or turned off according to the second driving voltage signal so as to control current flowing through the second lighting module.

7. The dimming module of claim 6, wherein the first driving circuit comprises a plurality of first driving units electrically coupled in series to each other, and the first driving units correspond to a plurality of first light emitting diodes electrically coupled in series to each other in the first lighting module.

8. The solid state lighting device of claim 7, wherein the second driving circuit comprises a plurality of second driving units electrically coupled in series to each other, and the second driving units correspond to a plurality of second light emitting diodes electrically coupled in series to each other in the second lighting module.

9. The dimming module of claim 1, wherein the phase control circuit is further configured to output the control voltage signal to the first lighting module to supply power to the first lighting module.

10. A solid state lighting device, comprising:

a first lighting module comprising a first color temperature;

a second lighting module comprising a second color temperature different from the first color temperature;

a first driving circuit, configured to receive a first driving voltage to drive the first lighting module;

a second driving circuit, configured to receive a second driving voltage to drive the second lighting module;

a phase control circuit, configured to output a control voltage signal, wherein when the phase control circuit receives a dimming command, the phase control circuit controls a phase delay angle of the control voltage signal according to the dimming command; and a processing circuit, electrically coupled to the phase control circuit, the first driving circuit, and the second driving circuit, and configured to receive the control voltage signal and adjust the first driving voltage signal and the second driving voltage signal according to the phase delay angle;

wherein the phase control circuit outputs the non-full-phase control voltage signal with the phase delay angle to the processing circuit in one or more cycles and then the phase control circuit outputs the full-wave rectified voltage with full waveform; and wherein when the dimming command is a first type of dimming instructions, the phase delay angle comprises a first angle, and when the dimming command is a second type of dimming instructions different from the first type of dimming instructions, the phase delay angle comprises a second angle different from the first angle.

11. The solid state lighting device of claim 10, wherein when the phase delay angle comprises the first angle, the processing circuit adjusts the first driving voltage signal and the second driving voltage signal respectively to control the brightness of the solid state lighting device, and when the phase delay angle comprises the second angle, the processing circuit adjusts the first driving voltage signal and the second driving voltage signal respectively to control the color temperature of the solid state lighting device.

12. The solid state lighting device of claim 10, wherein the phase control circuit is further electrically coupled to the first driving circuit and the second driving circuit and configured to output the control voltage signal to the first driving circuit and the second driving circuit respectively to supply power to the first lighting module and the second lighting module.

13. The solid state lighting device of claim 10, further comprising a rectifying circuit, wherein the rectifying circuit is configured to convert an input ac voltage to a rectified voltage signal, and the phase control circuit is electrically coupled to the rectifying circuit, and configured to receive the rectified voltage signal in order to output the control voltage signal.

14. The solid state lighting device of claim 10, wherein the first driving circuit comprises a first switch, wherein a control terminal of the first switch is configured to receive the first driving voltage signal, such that the first switch is selectively turned on or turned off according to the first driving voltage signal so as to control current flowing through the first lighting module.

15. The solid state lighting device of claim 14, wherein the second driving circuit comprises a second switch, wherein a control terminal of the second switch is configured to receive the second driving voltage signal, such that the second switch is selectively turned on or turned off according to the second driving voltage signal so as to control current flowing through the second lighting module.

16. The solid state lighting device of claim 10, wherein the first driving circuit comprises a plurality of first driving units electrically coupled in series to each other, and the first driving units correspond to a plurality of first light emitting diodes electrically coupled in series to each other in the first lighting module.

17. The solid state lighting device of claim 16, wherein the second driving circuit comprises a plurality of second driving units electrically coupled in series to each other, and the second driving units correspond to a plurality of second light emitting diodes electrically coupled in series to each other in the second lighting module.

18. A dimming method, comprising:

receiving, by a phase control circuit, a dimming command from an external device;

determining, by the phase control circuit, the dimming command is a color temperature control command or a brightness control command;

outputting a control voltage signal with a first phase delay angle when the dimming command is the brightness control command;

outputting the control voltage signal with a second phase delay angle different from the first phase delay angle when the dimming command is the color temperature control command;

adjusting a first driving voltage signal and a second driving voltage signal according to the control voltage signal; and driving a first lighting module and a second lighting module respectively according to the first driving voltage signal and the second driving voltage signal; and outputting a full-wave rectified voltage with full waveform after the non-full-phase control voltage signal with the first phase delay angle or the second phase delay angle in one or more cycles is outputted.

19. The dimming method of claim 18, further comprising:

adjusting the amplitude of a first current flowing through the first lighting module and a second current flowing through the second lighting module according to the first driving voltage signal and the second driving voltage signal when the dimming command is the brightness control command.

20. The dimming method of claim 18, further comprising: adjusting the ratio between a first current flowing through the first lighting module and a second current flowing through the second lighting module according to the first driving voltage signal and the second driving voltage signal when the dimming command is the color temperature control command.

* * * * *